US008947173B2

(12) United States Patent
Kroening

(10) Patent No.: US 8,947,173 B2
(45) Date of Patent: Feb. 3, 2015

(54) FERRITE CIRCULATOR WITH ASYMMETRIC FEATURES

(75) Inventor: Adam M. Kroening, Atlanta, GA (US)

(73) Assignee: Honeywell International Inc., Morristown, NJ (US)

( * ) Notice: Subject to any disclaimer, the term of this patent is extended or adjusted under 35 U.S.C. 154(b) by 159 days.

(21) Appl. No.: 13/588,337

(22) Filed: Aug. 17, 2012

(65) Prior Publication Data

US 2014/0049333 A1 Feb. 20, 2014

(51) Int. Cl.
*H01P 1/39* (2006.01)

(52) U.S. Cl.
CPC ..... *H01P 1/39* (2013.01)
USPC ..... 333/1.1

(58) Field of Classification Search
CPC ..... H01P 1/39
USPC ..... 333/1.1, 24.2
See application file for complete search history.

(56) References Cited

U.S. PATENT DOCUMENTS

| | | | |
|---|---|---|---|
| 3,070,760 | A | 12/1962 | Wheeler |
| 3,341,789 | A | 9/1967 | Goodman et al. |
| 3,935,548 | A | 1/1976 | Rosenbaum et al. |
| 4,058,780 | A | 11/1977 | Riblet |
| 4,309,666 | A | 1/1982 | Ito et al. |
| 4,604,590 | A | 8/1986 | Mlinar et al. |
| 4,697,158 | A | 9/1987 | Hoover et al. |
| 5,473,294 | A | 12/1995 | Mizzoni et al. |
| 6,292,068 | B1 | 9/2001 | Martin |
| 6,885,257 | B2 | 4/2005 | Kroening |
| 7,242,263 | B2 | 7/2007 | Kroening |
| 7,561,003 | B2 | 7/2009 | Kroening |
| 2003/0107447 | A1 | 6/2003 | Kroening |
| 2004/0119550 | A1 | 6/2004 | Trammell et al. |
| 2005/0179504 | A1 | 8/2005 | Kroening |
| 2006/0232353 | A1 | 10/2006 | Kroeing |

(Continued)

FOREIGN PATENT DOCUMENTS

| | | |
|---|---|---|
| DE | 3026257 | 2/1982 |
| EP | 0239210 | 9/1987 |

(Continued)

OTHER PUBLICATIONS

European Patent Office, "Office Action", "from Foreign Counterpart of U.S. Appl. No. 13/588,314", Dec. 16, 2013, pp. 1-9, Published in: EP.

(Continued)

*Primary Examiner* — Stephen Jones
(74) *Attorney, Agent, or Firm* — Fogg & Powers LLC

(57) ABSTRACT

A ferrite element for a circulator comprises a first segment extending in a first direction from a center portion of the ferrite element; a second segment extending in a second direction from the center portion of the ferrite element; and a third segment extending in a third direction from the center portion of the ferrite element. Each of the first segment, the second segment, and the third segment has a respective width and include a channel located at a respective distance from a center point of the ferrite element. At least one of the respective width of each segment or the respective distance from the center point for the channel in each segment is different for each respective segment such that the first segment operates over a first frequency sub-band, the second segment operates over a second frequency sub-band, and the third segment operates over a third frequency sub-band.

20 Claims, 8 Drawing Sheets

(56) References Cited

U.S. PATENT DOCUMENTS

| | | | | |
|---|---|---|---|---|
| 2006/0250195 | A1* | 11/2006 | Kroening | 333/1.1 |
| 2006/0261909 | A1 | 11/2006 | Kroening | |
| 2009/0108953 | A1 | 4/2009 | Kroening | |
| 2010/0109791 | A1 | 5/2010 | Lingel | |
| 2014/0049332 | A1 | 2/2014 | Kroening | |
| 2014/0049334 | A1 | 2/2014 | Kroening | |
| 2014/0049335 | A1 | 2/2014 | Kroening | |

FOREIGN PATENT DOCUMENTS

| | | |
|---|---|---|
| JP | 51117853 | 10/1976 |
| JP | 52152145 | 12/1977 |
| SU | 1256109 | 9/1986 |
| WO | 8806807 | 9/1988 |

OTHER PUBLICATIONS

European Patent Office, "Office Action from EP Application No. 13179326.7 mailed on Jan. 3, 2014", "from Foreign Counterpart of U.S. Appl. No. 13/588,374", Jan. 3, 2014, pp. 1-5, Published in: EP.
Billings et al., "Ferrite Circulator Switches and Their Applications", Nov. 2003, pp. 1-2.
Joubert, "Design of Unequal H-Plane Waveguide Power Dividers for Array Applications", Feb. 1997, pp. 1-6.
Liang et al., "A Rigorous Three Plane Mode-Matching Technique for Characterizing Waveguide T-Junctions, and its Application in Multiple", Dec. 12, 1991, pp. 2138-2147.
Lin Lin, "Theory and Design of Ferrite Latching Waveguide Junction Circulators", Dec. 1987, pp. 1-3.
Pozar, "10.6 Ferrite Circulators", Feb. 2004, pp. 1-4.
European Patent Office, "European Search Report", "from Foreign Counterpart of U.S. Appl. No. 13/588,314", Dec. 3, 2013, pp. 1-5, Published in: EP.
European Patent Office, "Office Action", "from Foreign Counterpart of U.S. Appl. No. 13/588,337", Dec. 9, 2013, pp. 1-6, Published in: EP.
European Patent Office, "European Search Report", "from Foreign Counterpart of U.S. Appl. No. 13/588,337", Nov. 26, 2013, pp. 1-4, Published in: EP.
European Patent Office, "European Search Report", "from Foreign Counterpart of U.S. Appl. No. 13/588,374", Dec. 9, 2013, pp. 1-3, Published in: EP.
U.S. Patent and Trademark Office, "Office Action", "from U.S. Appl. No. 13/588,314", Apr. 10, 2014, pp. 1-25, Published in: US.
U.S. Patent and Trademark Office, "Notice of Allowance", "from U.S. Appl. No. 13/588,418", Mar. 26, 2014, pp. 1-22, Published in: US.
U.S. Patent and Trademark Office, "Office Action", "from U.S. Appl. No. 13/588,374", Apr. 17, 2014, pp. 1-26, Published in: US.

* cited by examiner

FERRITE CIRCULATOR WITH ASYMMETRIC FEATURES

BACKGROUND

Ferrite circulators have a wide variety of uses in commercial and military, space and terrestrial, and low and high power applications. A waveguide circulator may be implemented in a variety of applications, including but not limited to low noise amplifier (LNA) redundancy switches, T/R modules, isolators for high power sources, and switch matrices. One important application for such waveguide circulators is in space, especially in satellites where extreme reliability is essential and where size and weight are very important. Ferrite circulators are desirable for these applications due to their high reliability, as there are no moving parts required. This is a significant advantage over mechanical switching devices. In most of the applications for waveguide switching and non-switching circulators, small size, low mass, and low insertion loss are significant qualities.

A commonly used type of waveguide circulator has three waveguide arms arranged at 120° and meeting in a common junction. This common junction is loaded with a non-reciprocal material such as ferrite. When a magnetizing field is created in this ferrite element, a gyromagnetic effect is created that can be used for switching the microwave signal from one waveguide arm to another. By reversing the direction of the magnetizing field, the direction of switching between the waveguide arms is reversed. Thus, a switching circulator is functionally equivalent to a fixed-bias circulator but has a selectable direction of circulation. Radio frequency (RF) energy can be routed with low insertion loss from one waveguide arm to either of the two output arms. If one of the waveguide arms is terminated in a matched load, then the circulator acts as an isolator, with high loss in one direction of propagation and low loss in the other direction.

SUMMARY

In one embodiment, a ferrite element for a circulator is provided. The ferrite element comprises a first segment extending in a first direction from a center portion of the ferrite element; a second segment extending in a second direction from the center portion of the ferrite element; and a third segment extending in a third direction from the center portion of the ferrite element. Each of the first segment, the second segment, and the third segment has a respective width and include a channel located at a respective distance from a center point of the ferrite element. At least one of the respective width of each segment or the respective distance from the center point for the channel in each segment is different for each respective segment such that the first segment operates over a first frequency sub-band, the second segment operates over a second frequency sub-band, and the third segment operates over a third frequency sub-band.

DRAWINGS

Understanding that the drawings depict only exemplary embodiments and are not therefore to be considered limiting in scope, the exemplary embodiments will be described with additional specificity and detail through the use of the accompanying drawings, in which.

In accordance with common practice, the various described features are not drawn to scale but are drawn to emphasize specific features relevant to the exemplary embodiments.

DETAILED DESCRIPTION

In the following detailed description, reference is made to the accompanying drawings that form a part hereof, and in which is shown by way of illustration specific illustrative embodiments. However, it is to be understood that other embodiments may be utilized and that logical, mechanical, and electrical changes may be made. The following detailed description is, therefore, not to be taken in a limiting sense.

Figure 1:
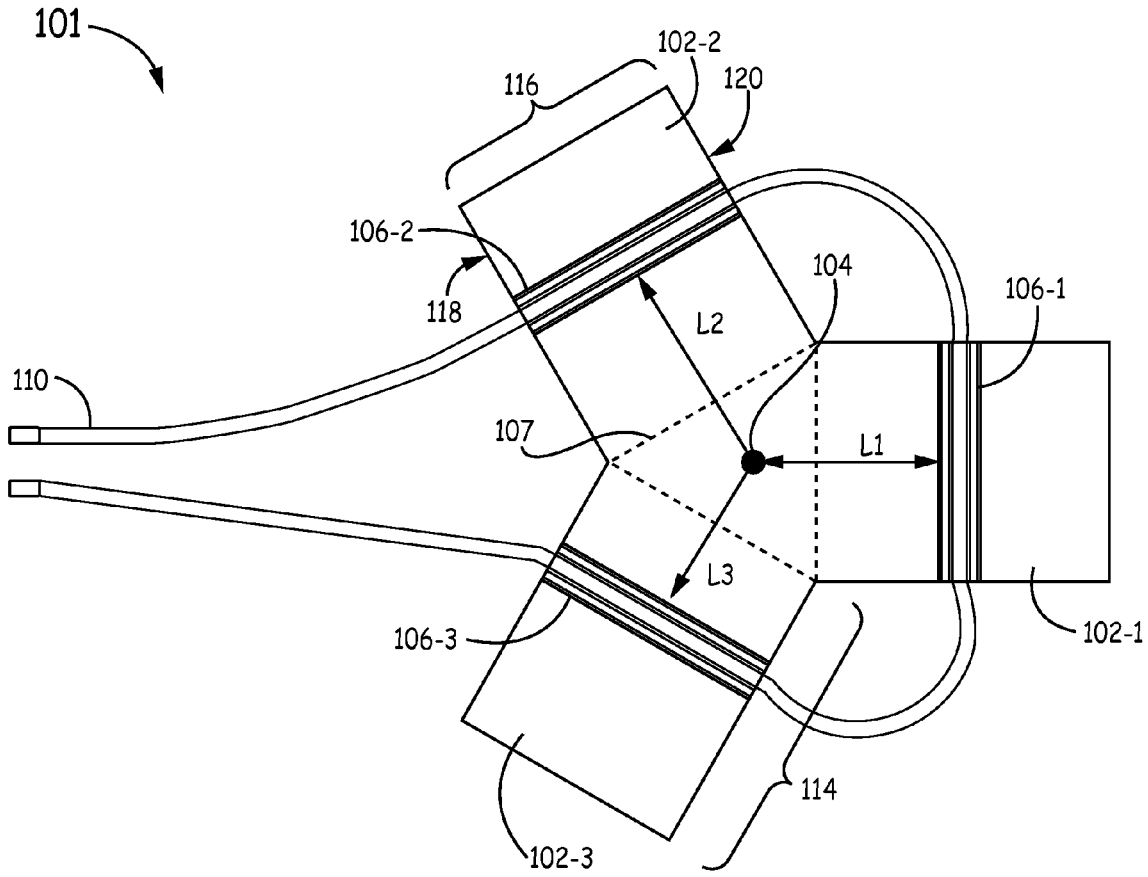
FIG. 1 is a top view of one embodiment of an exemplary ferrite element having asymmetric features.

FIG. 1 is a cross-sectional top view of one embodiment of an exemplary asymmetric ferrite element 101 used in a circulator. Ferrite element 101 includes 3 legs or segments 102-1, 102-2, and 102-3, each of which extends out from a center portion 107 at approximately 120° angles from one another. Each segment 102 has a length 114 and a width 116. The length 114 and width 116 of each leg 102 are approximately equal to the length 114 and width 116 of the other legs 102 in the embodiment of FIG. 1. In addition, each segment 102 includes a respective channel 106. As used herein, the terms "channel", "aperture", and "hole" can be used interchangeably. Each channel 106 begins at a first side 118 of the respective segment 102 and ends at a second side 120 of the respective segment 102. The second side 120 is opposite the first side 118. Hence, each channel 106 extends through the width 116 of the respective segment 102 in a direction that is approximately perpendicular to the first side 118 and the second side 120.

The channel 106-1 in leg 102-1 is located a distance L1 from a center point 104. The channel 106-2 in leg 102-2 is located a distance L2 from the center point 104. The channel 106-3 in leg 103-3 is located a distance L3 from the center point 104. The distance L2 is greater than the distance L1. The distance L1 is greater than the distance L3. Each of the respective channels 106 can be created by boring a hole through the respective leg 102 of the ferrite element 101, for example. If a magnetizing winding (also referred to herein as a wire) is inserted through each of the respective apertures 106, then a magnetizing field may be established in the ferrite element 101 by applying a current pulse to one of the magnetizing windings. For example, in some embodiments, the pulse length is on the order of 100 nanoseconds wide and 4-12 amps at its peak through the wire. The pulse latches the ferrite element 101 into a certain magnetization and then stops. Thus, current does not have to be continually applied to the selected wire.

In the example shown in FIG. 1, a wire 110 is inserted through the channels 106 in each leg 102. The respective diameter of the channels 106 is determined based on the diameter of the wire 110 placed through the respective channels 106. In particular, the respective diameter of the channels 106 is greater than the diameter of the wire 110 such that the wire 110 can be inserted through the respective channels 106. The polarity of the magnetizing field may be switched, alternately, by switching the polarity of the current applied to the wire 110 to thereby provide a switchable circulator. However, it is to be understood that, in some embodiments, the polarity is not switched to provide a fixed circulator. A fixed circulator can be connected, for example, to a single antenna to allow both receive (Rx) and transmit (Tx) transmission through the single antenna. Alternatively, a switching circulator can be used, in some embodiments, for both Rx and Tx transmission and for switching between multiple antennas in switched beam antenna applications.

The length L1 to the channel 106-1 is measured from the center point 104 to approximately a midpoint of the channel 106-1. Similarly, the length L2 to the channel 106-2 and the length L3 to the channel 106-3 are each measured from the center point 104 to approximately a midpoint of the respective channels 106-2 and 106-3. The length from the center point 104 to the respective channel 106 influences the operating frequency of the switchable circulator in which the ferrite element 101 is implemented. In particular, the volume of the resonant section of the ferrite element 101 determines the frequency of operation to the first order. The resonant section of the ferrite element 101 includes the center portion 107 and the portion of each leg 102 between the center portion 107 of the Y-shaped ferrite element 101 and the location of the wire 110 carrying a current pulse. The sections of the ferrite element in the area outside of the resonant section volume may act as return paths for the bias fields in the resonant section and as impedance transformers out of the resonant section By using asymmetric distances L1, L2, and L3, between the center point 104 and the respective channel 106, each leg 102 of the ferrite element 101 is configured to operate over a different frequency sub-band. In particular, as discussed above, the volume of the resonant section determines the operating frequency band to the first order. Since the distance from the center point 104 to each respective channel 106 is different, the volume of the resonant section is different for each leg 102. That is, the first leg is associated with a first resonant section volume, the second leg is associated with a second resonant section volume, and the third leg is associated with a third resonant section volume.

In the example of FIG. 1, the distance L2 is the greatest. Since the operating frequency band is inversely related to the volume of the resonant section, leg 102-2 operates a lower frequency sub-band than legs 102-1 and 102-3. Similarly, since the distance L3 is the smallest, leg 102-3 operates at a higher frequency sub-band than legs 102-1 and 102-2. In some embodiments, the different frequency sub-bands are used for both Rx and Tx transmission through a single antenna. Alternatively, in other embodiments, one sub-band is used for Rx and a second sub-band is used for Tx.

In the example of FIG. 1, the asymmetry in the ferrite element is achieved through different distances L1, L2, and L3 between the center point 104 and the respective channel 106 of each leg 102. That is, the respective resonant section volumes are defined, at least in part, by the respective distances to the channel 106 of each leg 102. In other embodiments, the asymmetry is achieved through varying the shape of each respective leg. For example, the width of each leg can vary. In such embodiments, the respective width of each leg defines, at least in part, the respective resonant section volume.

Figure 2:
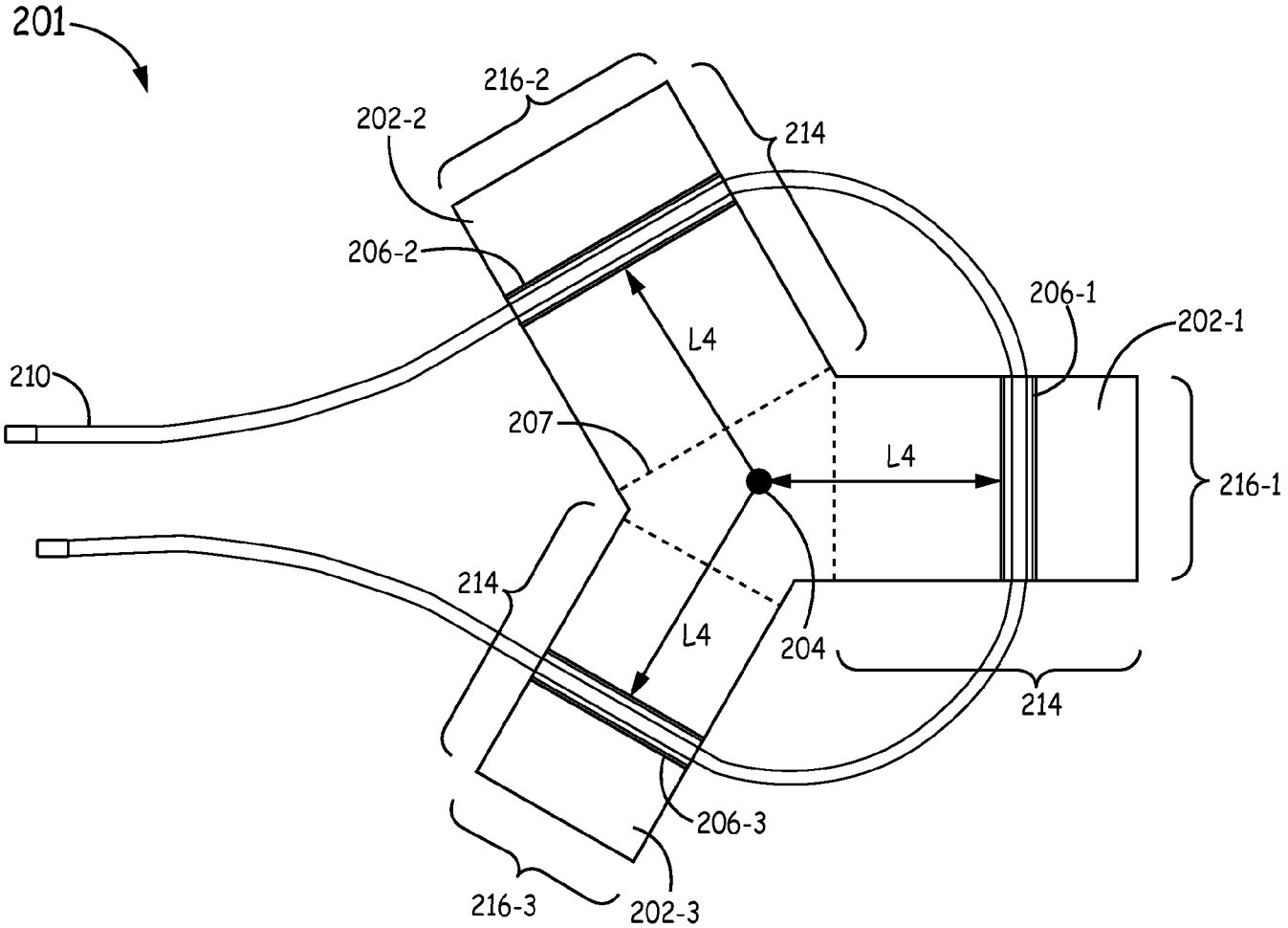
FIG. 2 is a top view of another embodiment of an exemplary ferrite element having asymmetric features.

In the example of FIG. 2, each leg 202 has the same length 214, but a different respective width 216. In particular, in the example in FIG. 2, leg 202-2 has a width 216-2 which is greater than the widths 216-1 and 216-3. Leg 202-3 in this example has a width 216-3 which is smaller than the widths 216-1 and 216-2. Since the distance L4 between the center point 204 and the respective channel 206 is the same for each leg 202, the volume of the resonant section for each leg 202 is determined by the respective width 216 of each leg 202 and the volume of the center portion 207. Therefore, in the exemplary embodiment of FIG. 2, leg 202-2 operates at a lower frequency sub-band than legs 202-1 and 202-3 because it has the greatest volume. Similarly, leg 202-3 operates at a higher frequency sub-band than legs 202-1 and 202-2 because it has the smallest width 216-3.

As discussed above, a current pulse can be applied to wire 210 to latch the ferrite element 201 into a certain magnetization. The pulse then stops and does not need to be applied continuously. A current pulse having an opposite polarity can be applied to the wire 210 to provide a switchable circulator. Alternatively, a fixed circulator can be provided by not switching the polarity of pulses applied to the wire 210.

Figure 3A:
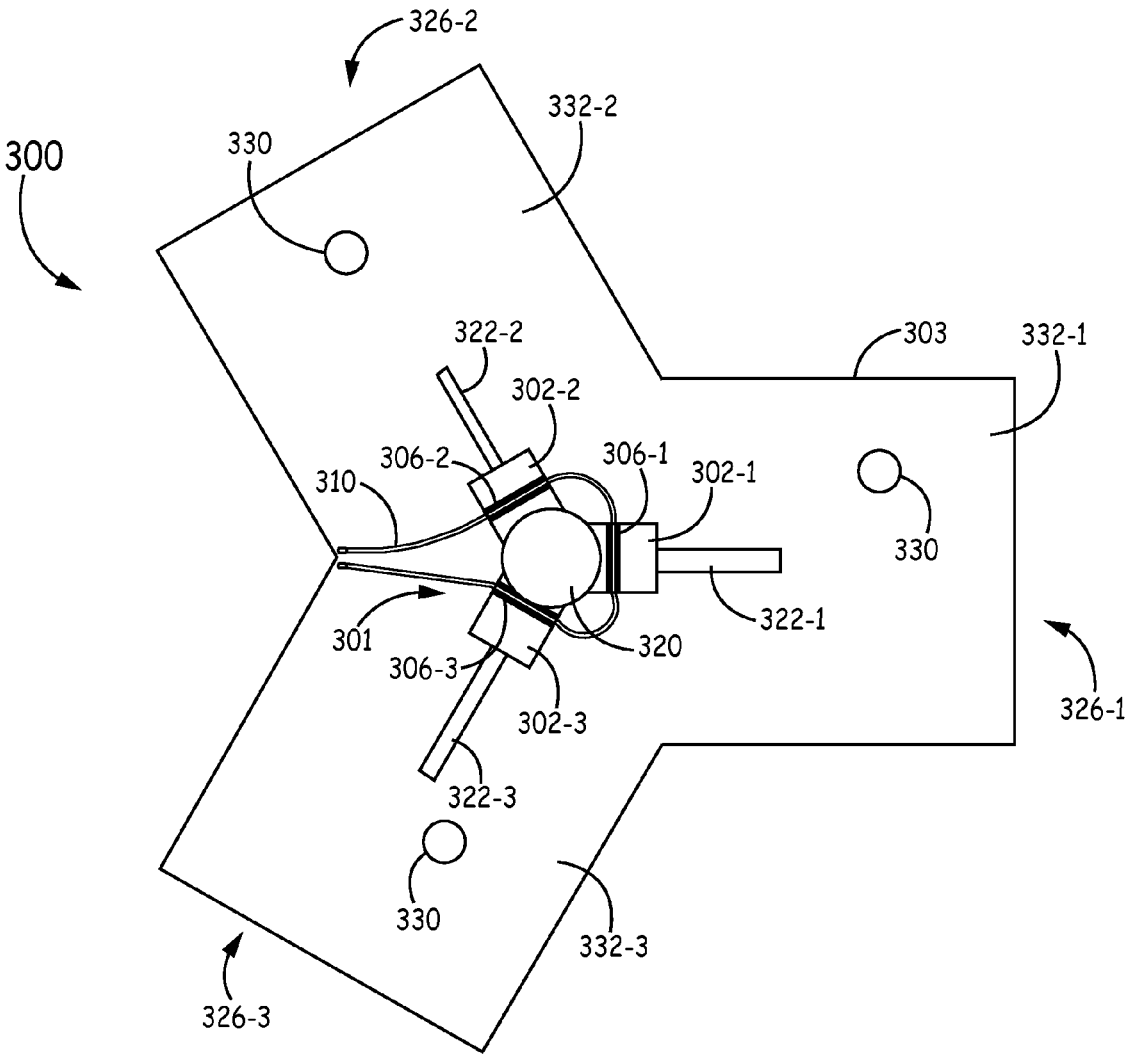
FIG. 3A is a top view of one embodiment of an exemplary circulator with asymmetric features.
Figure 3B:
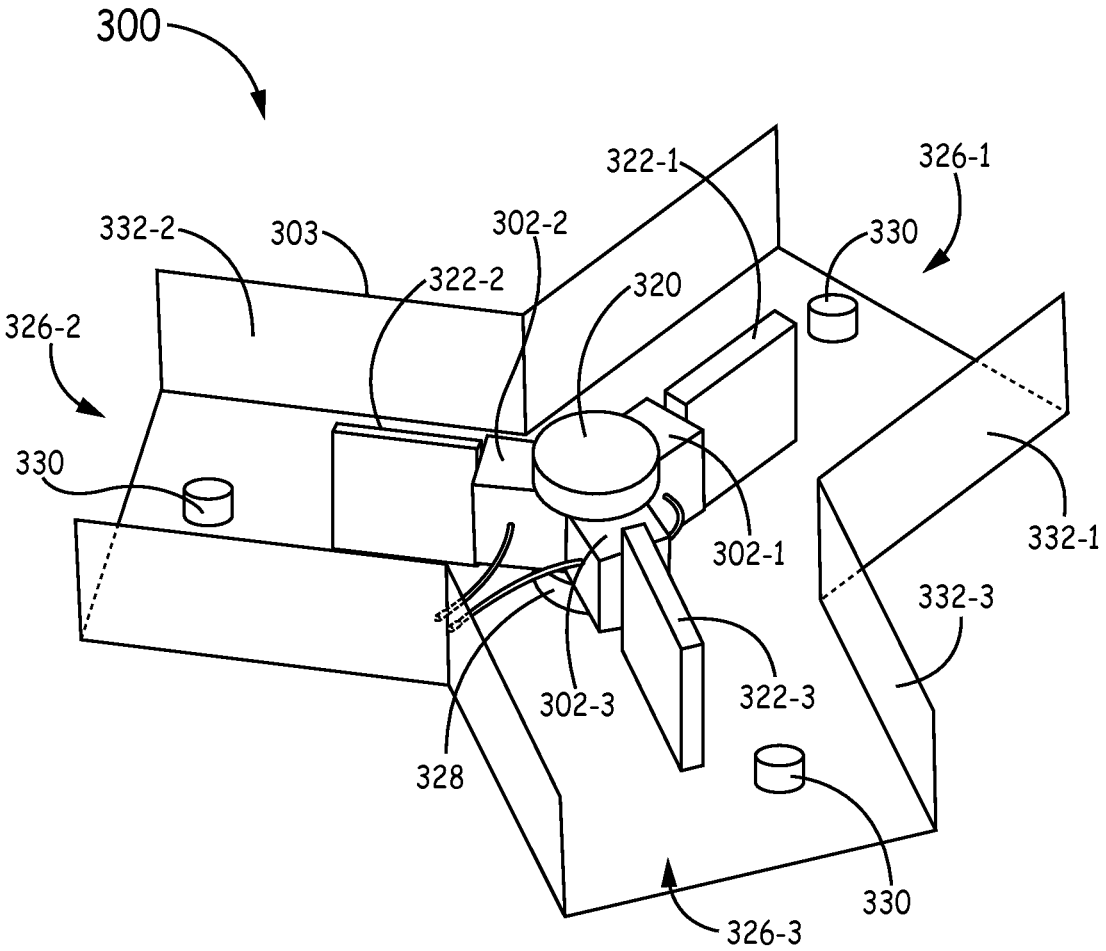
FIG. 3B is a perspective view of one embodiment of the exemplary circulator in FIG. 3A.

FIG. 3A is a top view of an exemplary asymmetric circulator 300 and FIG. 3B is an isometric view of the exemplary asymmetric circulator 300. The asymmetric circulator 300 includes a waveguide structure 303 which defines a plurality of waveguide arms 332 that meet in a shared junction and are generally air-filled. For the purposes of this description, the terms "air-filled," "empty," "vacuum-filled," or "unloaded" may be used interchangeably to describe a waveguide structure. The arms 332 are arranged at approximately 120 degree angles from each other in this example. The conductive waveguide structure 303 may also include waveguide input/output ports 326-1 . . . 326-3. The ports 326 can be used to provide interfaces, such as for signal input and output, for example.

The asymmetric circulator 300 also includes a ferrite element 301 disposed in the air-filled waveguide structure 303, as shown in FIGS. 3A and 3B. Additionally, a dielectric spacer 320 is disposed on a top surface of ferrite element 301 and a dielectric spacer 328 is disposed on a bottom surface of the ferrite element 301. The materials selected for the respective spacers 320 and 328 can be chosen independently in terms of microwave and thermal properties to allow for more flexibility in the impedance matching of the circulator 300. The diameter of the spacers 320 and 328 are selected for impedance matching purposes. Although spacers 320 and 328 are shown in FIGS. 3A and 3B as having a circular shape, any geometry may be used for the spacers 320 and 328. In addition, in some embodiments, one or more empirical matching elements 330 can be optionally included on a conductive portion of the waveguide structure 303. The waveguide structure 303 can be comprised of any conductive material, such as, but not limited to, aluminum, silver plated metal, or gold plated metal. The matching elements 330 can be capacitive/inductive dielectric or metallic buttons that are used to empirically improve the impedance match over the desired operating frequency sub-band.

In addition, in the example of FIG. 3, the asymmetric circulator 300 includes a respective dielectric transformer 322 coupled to an end of each leg 302 of the ferrite element 301 for purposes of impedance matching the ferrite element to the waveguide interface. The dielectric transformers 322 are typically used to match the lower impedance of the ferrite element to the higher impedance of the air-filled waveguide so as to reduce loss. In particular, in this embodiment, the shape of each respective dielectric transformer 322 is different to provide the desired impedance matching for each different operating sub-band. For example, in this embodiment, the dielectric transformer 322-2 is shorter and narrower than the dielectric transformers 322-1 and 322-3, whereas dielectric transformer 322-1 is wider than the dielectric transformers 322-2 and 322-3.

It is to be understood that the dimensions of each dielectric transformer 322 vary based on the desired impedance matching for the specific implementation. For example, the width, height, length, number of steps in the dielectric transformers, and location of the steps in the transformers 322 can vary to thus achieve the desired impedance matching of the ferrite element 301 to the corresponding waveguide port 326. Additionally, in other embodiments, steps in the height or width of the waveguide arms 332 can be used in addition to or in lieu of variances in the dimensions of the transformers 322 to achieve the desired impedance matching.

The ferrite element 301 also includes a respective channel 306 in each of the legs 302. In particular, in this example, the location of each channel 306 in the respective leg 302 differs as described above in the exemplary ferrite element 101 of FIG. 1. Thus, asymmetry in the frequency sub-band of each leg 302 is achieved through the different distances between a center point of the ferrite element and the location of the respective channel 306. However, it is to be understood that in other embodiments, a ferrite element similar to ferrite element 201 can be implemented in a circulator, such as circulator 300, to provide an asymmetric circulator having different operating frequency sub-bands for each leg.

A magnetizing winding 310 is inserted through the channel 306 in each leg 302. A current pulse is applied to the wire 310 to latch the ferrite element into a certain magnetization, as discussed above. Additionally, a switchable circulator can be implemented by switching the polarity of the current pulse applied to the magnetizing winding 310. In particular, by switching the polarity of the current pulse, the signal flow direction can be switched. For example, for a first polarity of the current pulse, a first signal flow configuration in the asymmetric three-port circulator 300 is 326-1→326-2, 326-2→326-3, and 326-3→326-1. That is a signal input via port 326-1 is output via port 326-2; a signal input via port 326-2 is output via port 326-3; and a signal input via 326-3 is output via port 326-1. For a second polarity of the current pulse, a second signal flow configuration in the asymmetric circulator 300 is 326-1→326-3, 326-3→326-2, and 326-2→326-1.

In an ideal configuration, no portion of the input signals should result on the isolated port. The isolated port is the port over which the signal is not intended to be output. For example, if a signal is input on port 326-1, the output port in the first signal flow configuration described above is port 326-2 and the isolated port is 326-3. Hence, ideally no signal should result on port 326-3 in such a configuration. Any loss in signal from the input port to the output port is referred to as the insertion loss. Signal transferred from the input port to the isolated port is referred to as isolation.

Figure 5A:
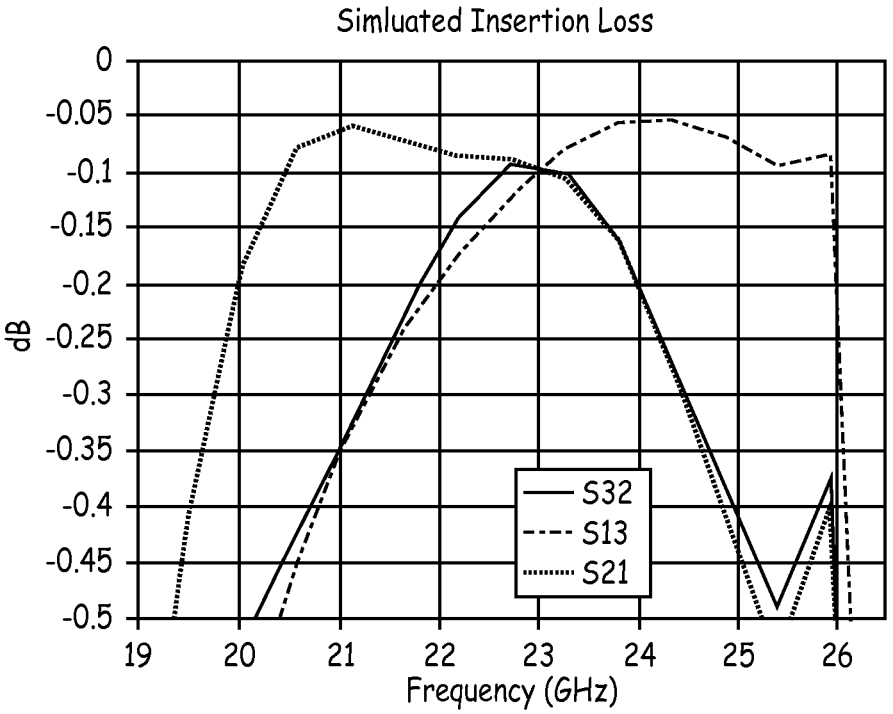
FIG. 5A is a graph representing exemplary insertion loss data for an exemplary embodiment of a circulator having asymmetric features.
Figure 5B:
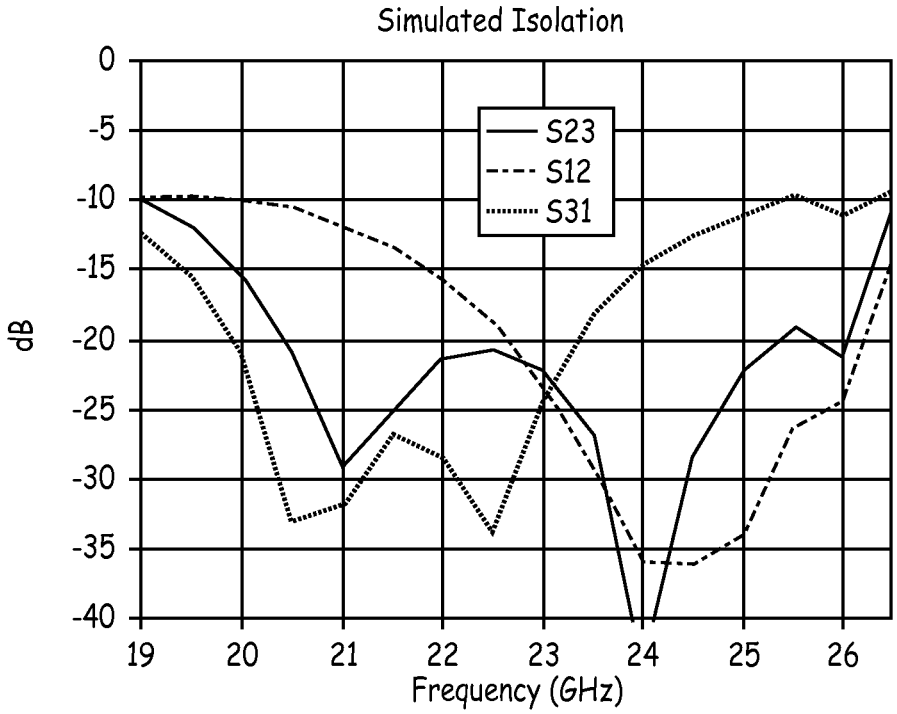
FIG. 5B is a graph representing exemplary isolation data for an exemplary embodiment of a circulator having asymmetric features.
Figure 5C:
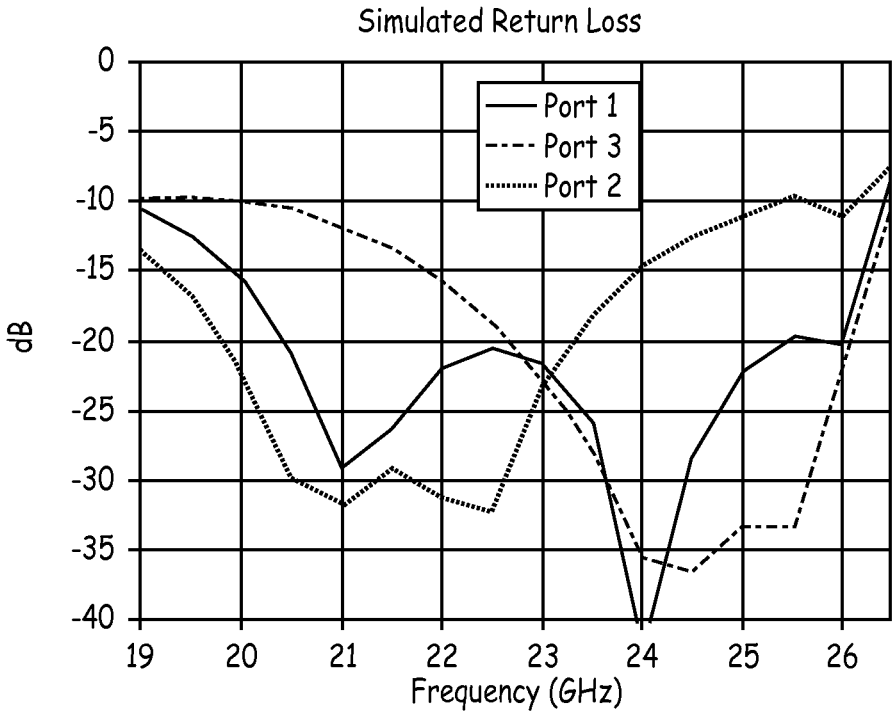
FIG. 5C is a graph representing exemplary return loss data for an exemplary embodiment of a circulator having asymmetric features.

It is typically desirable to configure the circulator 300 to decrease the insertion loss and increase the isolation. For example, in one embodiment, the circulator is configured to have a few tenths of a dB insertion loss and approximately 20 dB isolation. FIGS. 5A-5C are graphs representing exemplary simulated insertion loss, isolation, and return loss data for an exemplary embodiment of the asymmetric circulator having different operation frequency sub-bands for each leg. However, it is to be understood that actual measurements of insertion loss, isolation, and return loss data will vary based on the specific implementation. In FIG. 5A, the label S21 refers to a signal traveling from a first port, such as port 326-1, to a second port, such as port 326-2. The label S32 refers to a signal traveling from the second port to a third port, such as port 326-3. The label S13 refers to a signal traveling from the third port to the first port. Similarly, in FIG. 5B, the label S23 refers to a signal traveling from the third port to the second port; the label S12 refers to a signal traveling from the second port to the first port; and the label S31 refers to a signal traveling from the first port to the third port.

In one example of a fixed circulator using the first signal flow configuration, a receiver can be coupled to the port 326-2, a transmitter can be coupled to the port 326-3 and a single antenna can be coupled to the port 326-1. Thus, signals received at the antenna over a first frequency sub-band are provided to the receiver via port 326-2 and signals in a second frequency sub-band from the transmitter coupled to port 326-3 are provided to the antenna via port 326-1.

In other embodiments implementing an asymmetric switchable circulator, the second current pulse with a second polarity is applied to the wire 310. In one embodiment of an asymmetric switchable circulator, for example, a first transmitter configured to operate over a first frequency sub-band is coupled to port 326-2 and a second transmitter configured to operate over a second frequency sub-band is coupled to port 326-3. Thus, in the first signal flow configuration, signals from the second transmitter are transmitted over an antenna coupled to the port 326-1. In the second signal flow configuration, signals from the first transmitter are transmitted over the antenna coupled to the port 326-1. Thus, the asymmetric circulator 300 can be implemented in various systems.

Figure 4:
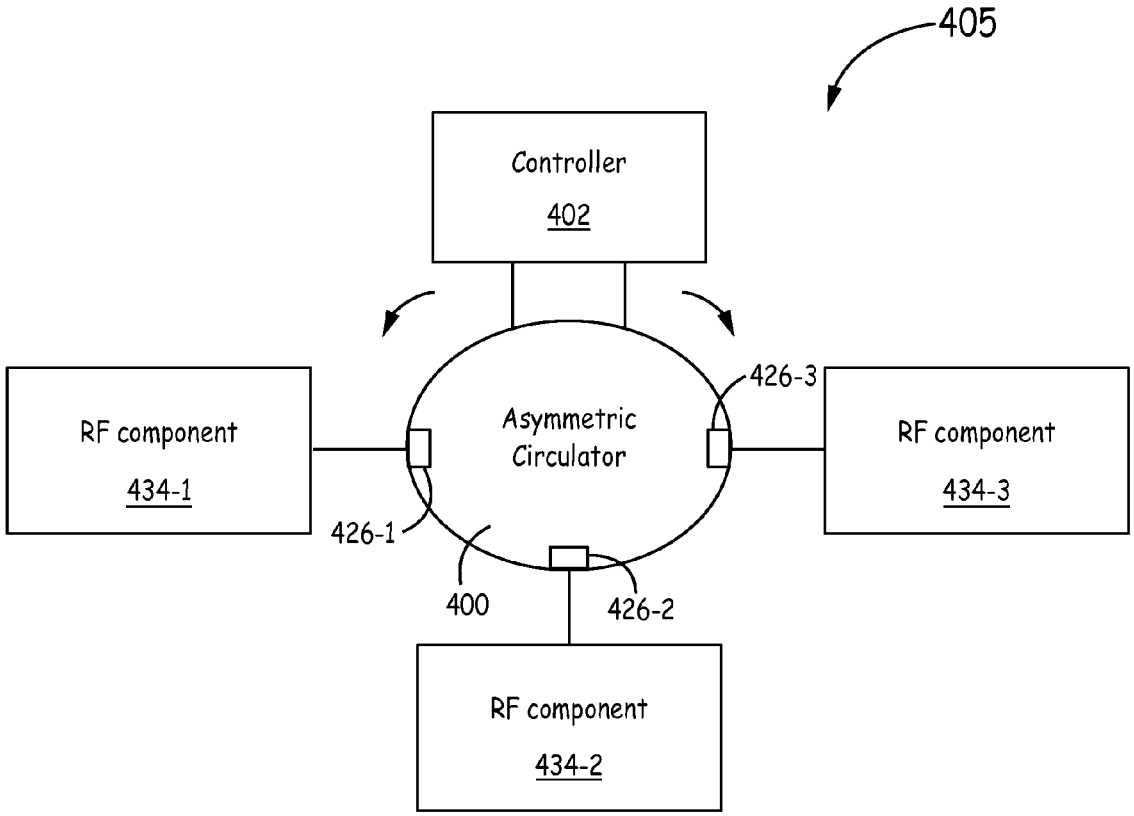
FIG. 4 is a high level block diagram of one embodiment of a system having a circulator with asymmetric features.

For example, FIG. 4 is a high level block diagram of one embodiment of an exemplary system 405 which implements an asymmetric circulator 400, such as circulator 300 discussed above. System 405 can be implemented as any radio frequency (RF) system such as, but not limited to, radar systems, satellite communication systems, and terrestrial communications networks. The asymmetric circulator 400 includes a ferrite element in which the volume of the resonant section is different for each leg of the circulator. For example, the volume can be changed by locating a respective channel in each leg at a different length as described above with respect to FIG. 1. Alternatively the volume of the resonant section can be changed for each leg by configuring each leg with a different width as discussed above with respect to FIG. 2. Thus, the asymmetric circulator 400 includes different respective operating frequency sub-bands for each leg.

The system 405 also includes a controller circuit 402 which is configured to provide a current pulse to a wire running through a channel in each leg as described above. Coupled to each port 426 is an RF component 434. Each RF component 434 can be implemented as one of a transmitter, a receiver, an antenna, or other load known to one of skill in the art. For example, in one embodiment, RF component 434-1 is implemented as an antenna, RF component 434-2 is implemented as a receiver, and RF component 434-3 is implemented as a transmitter. The asymmetric circulator 400 is configured, in such an embodiment, so that signals from the transmitter 434-3 are isolated from the receiver 434-2, but are passed through to the antenna 434-1 for transmission. Similarly, signals received via antenna 434-1 are isolated from the transmitter 434-3 and passed through to the receiver 434-2 in such an example embodiment. However, it is to be understood that, in other embodiments, the RF components 434 are implemented differently than in this exemplary embodiment.

Hence, through the use of the asymmetric circulator 400, the system 405 is able to support different frequency sub-bands on each port.

Example Embodiments

Example 1 includes a ferrite element for a circulator, the ferrite element comprising a first segment extending in a first direction from a center portion of the ferrite element; a second segment extending in a second direction from the center portion of the ferrite element; and a third segment extending in a third direction from the center portion of the ferrite element; wherein each of the first segment, the second segment, and the third segment has a respective width and include a channel located at a respective distance from a center point of the ferrite element; wherein at least one of the respective width of each segment or the respective distance from the center point for the channel in each segment is different for each respective segment such that the first segment operates over a first frequency sub-band, the second segment operates over a second frequency sub-band, and the third segment operates over a third frequency sub-band.

Example 2 includes the ferrite element of Example 1, wherein the respective distance from the center point for the channel is the same for each respective segment and; wherein the width of each respective segment is different from the respective width of the other segments.

Example 3 includes the ferrite element of Example 1, wherein the respective width of each segment is the same as the width of the other segments; and wherein the respective distance from the center point to the respective channel in each segment is different for each of the first, second, and third segments.

Example 4 includes the ferrite element of Example 1, wherein the respective distance from the center point to the respective channel in each segment is different for each of the first, second, and third segments; and wherein the width of each respective segment is different from the respective width of the other segments.

Example 5 includes the ferrite element of any of Examples 1-4, wherein the first segment, the second segment, and the third segment are arranged at approximately 120 degree angles from one another.

Example 6 includes a circulator comprising a waveguide having three ports; a ferrite element having three segments that each extend from a center portion, the ferrite element having a first resonant section volume associated with a first segment, a second resonant section volume, associated with a second segment, and a third resonant section volume associated with a third segment; and a magnetizing winding disposed in a respective channel located in each of the three segments; wherein the second resonant section volume is different from the first resonant section volume and the third resonant section volume is different from the first and second resonant section volumes such that the first segment operates over a first frequency sub-band, the second segment operates over a second frequency sub-band, and the third segment operates over a third frequency sub-band.

Example 7 includes the circulator of Example 6, wherein the first segment has a first width that defines, at least in part, the first resonant section volume; wherein the second segment has a second width, different from the first width, that defines, at least in part, the second resonant section volume; and wherein the third segment has a third width, different from the first width and the second width, that defines, at least in part, the third resonant section volume.

Example 8 includes the circulator of Example 6, wherein the channel in the first segment is located at a first distance from a center point of the ferrite element, the first distance defining, at least in part, the first resonant section volume; wherein the channel in the second segment is located at a second distance from the center point of the ferrite element, the second distance being different from the first distance and defining, at least in part, the second resonant section volume; and wherein the channel in the third segment is located at a third distance from the center point of the ferrite element, the third distance being different from the first distance and the second distance; wherein the third distance defines, at least in part, the third resonant section volume.

Example 9 includes the circulator of Example 6, wherein the first segment has a first width and the respective channel in the first segment is located at a first distance from a center point of the ferrite element, the first width and the first distance defining, at least in part, the first resonant section volume; wherein the second segment has a second width, different from the first width, and the respective channel in the second segment is located at a second distance from the center point of the ferrite element, the second distance being different from the first distance; wherein the second width and the second distance define, at least in part, the second resonant section volume; wherein the third segment has a third width, different from the first width and the second width, and the respective channel in the third segment is located at a third distance from the center point of the ferrite element, the third distance being different from the first distance and the second distance; wherein the third width and the third distance define, at least in part, the third resonant section volume.

Example 10 includes the circulator of any of Examples 6-9, further comprising a dielectric spacer disposed on at least one of a top surface of the ferrite element or a bottom surface of the ferrite element.

Example 11 includes the circulator of any of Examples 6-10, further comprising a respective dielectric transformer coupled to an end of each of the three segments of the ferrite element.

Example 12 includes the circulator of any of Examples 6-11, wherein the waveguide structure defines three arms that are arranged at approximately 120 degree angles from one another and meet at a common junction, each arm corresponding to one of the three ports.

Example 13 includes the circulator of any of Examples 6-12, wherein the three segments of the ferrite element are arranged at approximately 120 degree angles from one another.

Example 14 includes the circulator of any of Examples 6-13, further comprising one or more empirical impedance matching elements disposed on a conductive portion of the waveguide.

Example 15 includes a system comprising a circulator comprising a waveguide structure having three ports; a ferrite element disposed in the waveguide structure and comprising three segments that each extend from a center portion; and a wire disposed in a respective channel located in each of the three segments; wherein the ferrite element has a first resonant section volume associated with a first segment, a different second resonant section volume associated with a second segment, and a different third resonant section volume associated with a third segment such that the first segment operates over a first frequency sub-band, the second segment operates over a second frequency sub-band, and the third segment operates over a third frequency sub-band; the system further comprising a controller circuit coupled to the wire and configured to selectively apply a current pulse to the wire; and at least one radio frequency (RF) component coupled to a respective one of the ports in the waveguide structure.

Example 16 includes the system of Example 15, wherein the first segment of the ferrite element has a first width that defines, at least in part, the first resonant section volume; wherein the second segment of the ferrite element has a second width, different from the first width, that defines, at least in part, the second resonant section volume; and wherein the third segment of the ferrite element has a third width, different from the first width and the second width, that defines, at least in part, the third resonant section volume.

Example 17 includes the system of Example 15, wherein the respective channel in the first segment is located at a first distance from a center point of the ferrite element, the first distance defining, at least in part, the first resonant section volume; wherein the respective channel in the second segment is located at a second distance from the center point of the ferrite element, the second distance being different from the first distance and defining, at least in part, the second resonant section volume; and wherein the respective channel in the third segment is located at a third distance from the center point of the ferrite element, the third distance being different from the first distance and the second distance; wherein the third distance defines, at least in part, the third resonant section volume.

Example 18 includes the system of Example 15, wherein the first segment of the ferrite element has a first width and the respective channel in the first segment is located at a first distance from a center point of the ferrite element, the first width and the first distance defining, at least in part, the first resonant section volume; wherein the second segment of the ferrite element has a second width, different from the first width, and the respective channel in the second segment is located at a second distance from the center point of the ferrite element, the second distance being different from the first distance; wherein the second width and the second distance define, at least in part, the second resonant section volume; wherein the third segment of the ferrite element has a third width, different from the first width and the second width, and the respective channel in the third segment is located at a third distance from the center point of the ferrite element, the third distance being different from the first distance and the second distance; wherein the third width and the third distance define, at least in part, the third resonant section volume.

Example 19 includes the system of any of Examples 15-18, wherein the waveguide structure defines three arms that are arranged at approximately 120 degree angles from one another and meet at a common junction, each arm corresponding to one of the three ports.

Example 20 includes the system of any of Examples 15-19, wherein the three segments of the ferrite element are arranged at approximately 120 degree angles from one another.

Although specific embodiments have been illustrated and described herein, it will be appreciated by those of ordinary skill in the art that any arrangement, which is calculated to achieve the same purpose, may be substituted for the specific embodiments shown. Therefore, it is manifestly intended that this invention be limited only by the claims and the equivalents thereof.

What is claimed is:

1. A ferrite element for a circulator, the ferrite element comprising:

a first segment extending in a first direction from a center portion of the ferrite element;

a second segment extending in a second direction from the center portion of the ferrite element; and a third segment extending in a third direction from the center portion of the ferrite element;

wherein each of the first segment, the second segment, and the third segment has a respective width and each of the first segment, the second segment, and the third segment of the ferrite element includes a respective channel configured to receive a portion of the same magnetic winding and located at a respective distance from a center point of the ferrite element;

wherein at least one of the respective width of each segment or the respective distance from the center point for the channel in each segment is different for each respective segment such that the first segment operates over a first frequency sub-band, the second segment operates over a second frequency sub-band, and the third segment operates over a third frequency sub-band.

2. The ferrite element of claim 1, wherein the respective distance from the center point for the channel is the same for each respective segment and;

wherein the width of each respective segment is different from the respective width of the other segments.

3. The ferrite element of claim 1, wherein the respective width of each segment is the same as the width of the other segments; and wherein the respective distance from the center point to the respective channel in each segment is different for each of the first, second, and third segments.

4. The ferrite element of claim 1, wherein the respective distance from the center point to the respective channel in each segment is different for each of the first, second, and third segments; and wherein the width of each respective segment is different from the respective width of the other segments.

5. The ferrite element of claim 1, wherein the first segment, the second segment, and the third segment are arranged at approximately 120 degree angles from one another.

6. A circulator comprising:

a waveguide having three ports;

a ferrite element having three segments that each extend from a center portion, the ferrite element having a first resonant section volume associated with a first segment, a second resonant section volume, associated with a second segment, and a third resonant section volume associated with a third segment; and a magnetizing winding disposed in a respective channel located in each of the three segments of the ferrite element;

wherein the second resonant section volume is different from the first resonant section volume and the third resonant section volume is different from the first and second resonant section volumes such that the first segment operates over a first frequency sub-band, the second segment operates over a second frequency sub-band, and the third segment operates over a third frequency sub-band;

wherein at least one of a respective shape of each of the three segments of the ferrite element or a respective distance from a center point of the center portion for the respective channel in each of the three segments is different for each respective segment.

7. The circulator of claim 6, wherein the first segment has a first width that defines, at least in part, the first resonant section volume;

wherein the second segment has a second width, different from the first width, that defines, at least in part, the second resonant section volume; and wherein the third segment has a third width, different from the first width and the second width, that defines, at least in part, the third resonant section volume.

8. The circulator of claim 6, wherein the channel in the first segment is located at a first distance from a center point of the ferrite element, the first distance defining, at least in part, the first resonant section volume;

wherein the channel in the second segment is located at a second distance from the center point of the ferrite element, the second distance being different from the first distance and defining, at least in part, the second resonant section volume; and wherein the channel in the third segment is located at a third distance from the center point of the ferrite element, the third distance being different from the first distance and the second distance;

wherein the third distance defines, at least in part, the third resonant section volume.

9. The circulator of claim 6, wherein the first segment has a first width and the respective channel in the first segment is located at a first distance from a center point of the ferrite element, the first width and the first distance defining, at least in part, the first resonant section volume;

wherein the second segment has a second width, different from the first width, and the respective channel in the second segment is located at a second distance from the center point of the ferrite element, the second distance being different from the first distance;

wherein the second width and the second distance define, at least in part, the second resonant section volume;

wherein the third segment has a third width, different from the first width and the second width, and the respective channel in the third segment is located at a third distance from the center point of the ferrite element, the third distance being different from the first distance and the second distance;

wherein the third width and the third distance define, at least in part, the third resonant section volume.

10. The circulator of claim 6, further comprising a dielectric spacer disposed on at least one of a top surface of the ferrite element or a bottom surface of the ferrite element.

11. The circulator of claim 6, further comprising a respective dielectric transformer coupled to an end of each of the three segments of the ferrite element.

12. The circulator of claim 6, wherein the waveguide structure defines three arms that are arranged at approximately 120 degree angles from one another and meet at a common junction, each arm corresponding to one of the three ports.

13. The circulator of claim 6, wherein the three segments of the ferrite element are arranged at approximately 120 degree angles from one another.

14. The circulator of claim 6, further comprising one or more empirical impedance matching elements disposed on a conductive portion of the waveguide.

15. A system comprising:

a circulator comprising:

a waveguide structure having three ports;

a ferrite element disposed in the waveguide structure and comprising three segments that each extend from a center portion; and a wire disposed in a respective channel located in each of the three segments of the ferrite element;

wherein the ferrite element has a first resonant section volume associated with a first segment, a different second resonant section volume associated with a second segment, and a different third resonant section volume associated with a third segment such that the first segment operates over a first frequency sub-band, the second segment operates over a second frequency sub-band, and the third segment operates over a third frequency sub-band;

wherein at least one of a respective shape of each of the three segments of the ferrite element or a respective distance from a center point of the center portion for the respective channel in each of the three segments is different for each respective segment;

the system further comprising:

a controller circuit coupled to the wire and configured to selectively apply a current pulse to the wire; and at least one radio frequency (RF) component coupled to a respective one of the ports in the waveguide structure.

16. The system of claim 15, wherein the first segment of the ferrite element has a first width that defines, at least in part, the first resonant section volume;

wherein the second segment of the ferrite element has a second width, different from the first width, that defines, at least in part, the second resonant section volume; and wherein the third segment of the ferrite element has a third width, different from the first width and the second width, that defines, at least in part, the third resonant section volume.

17. The system of claim 15, wherein the respective channel in the first segment is located at a first distance from a center point of the ferrite element, the first distance defining, at least in part, the first resonant section volume;

wherein the respective channel in the second segment is located at a second distance from the center point of the ferrite element, the second distance being different from the first distance and defining, at least in part, the second resonant section volume; and wherein the respective channel in the third segment is located at a third distance from the center point of the ferrite element, the third distance being different from the first distance and the second distance;

wherein the third distance defines, at least in part, the third resonant section volume.

18. The system of claim 15, wherein the first segment of the ferrite element has a first width and the respective channel in the first segment is located at a first distance from a center point of the ferrite element, the first width and the first distance defining, at least in part, the first resonant section volume;

wherein the second segment of the ferrite element has a second width, different from the first width, and the respective channel in the second segment is located at a second distance from the center point of the ferrite element, the second distance being different from the first distance;

wherein the second width and the second distance define, at least in part, the second resonant section volume;

wherein the third segment of the ferrite element has a third width, different from the first width and the second width, and the respective channel in the third segment is located at a third distance from the center point of the ferrite element, the third distance being different from the first distance and the second distance;

wherein the third width and the third distance define, at least in part, the third resonant section volume.

19. The system of claim 15, wherein the waveguide structure defines three arms that are arranged at approximately 120 degree angles from one another and meet at a common junction, each arm corresponding to one of the three ports.

20. The system of claim 15, wherein the three segments of the ferrite element are arranged at approximately 120 degree angles from one another.

* * * * *